US010299526B2

(12) United States Patent
DuCasse

(10) Patent No.: US 10,299,526 B2
(45) Date of Patent: May 28, 2019

(54) HAT WITH WRAP-AROUND SUN SHADE

(71) Applicant: Sheila Beverly DuCasse, Gaithersburg, MD (US)

(72) Inventor: Sheila Beverly DuCasse, Gaithersburg, MD (US)

( * ) Notice: Subject to any disclaimer, the term of this patent is extended or adjusted under 35 U.S.C. 154(b) by 1273 days.

(21) Appl. No.: 14/044,027

(22) Filed: Oct. 2, 2013

(65) Prior Publication Data

US 2015/0089709 A1 Apr. 2, 2015

(51) Int. Cl.
*A42B 1/04* (2006.01)
*A42B 1/06* (2006.01)

(52) U.S. Cl.
CPC ..... *A42B 1/067* (2013.01)

(58) Field of Classification Search
CPC ..... A42B 1/061; A42B 1/004; A42B 1/067
See application file for complete search history.

(56) References Cited

U.S. PATENT DOCUMENTS 1,359,393 A * 11/1920 Leak ..... A42B 1/067 2/4
1,481,541 A * 1/1924 Douglas ..... A42B 1/067 2/172
1,505,183 A * 8/1924 Zucker ..... A42B 1/067 2/172
1,557,375 A * 10/1925 Stern ..... G02C 3/02 2/10
1,764,500 A * 6/1930 Blakesley ..... A61F 9/025 131/237
1,955,232 A * 4/1934 Gallaway ..... G02C 3/02 2/10
2,344,811 A * 3/1944 Gill ..... A41D 13/001 2/173
D141,256 S * 5/1945 Dannenberg ..... D2/879
2,472,033 A * 5/1949 Wetzel ..... A42B 1/066 2/4
2,897,510 A * 8/1959 Forbes-Robinson ..... A42B 1/066 2/172
3,016,545 A * 1/1962 Donahue ..... A42B 1/062 2/10
4,180,868 A * 1/1980 Snow ..... A42B 3/105 2/172
4,214,318 A * 7/1980 Gomez ..... A42B 1/067 2/4
4,821,341 A * 4/1989 Baptiste ..... A42B 1/062 2/10
4,980,928 A * 1/1991 Ellis ..... A41D 3/08 2/172
5,035,004 A * 7/1991 Koester ..... A42B 1/004 2/10

(Continued)

*Primary Examiner* — Richale Quinn
(74) *Attorney, Agent, or Firm* — Joscelyn Cockburn

(57) ABSTRACT

According to one embodiment of the present invention, the article or piece of clothing includes a hat having a crown and a bill extending outwardly from the crown. A wrap-around shoulder-length sun shade or sun screen is releasably coupled, by separating zippers, to the crown and bill of the hat. If the separating zippers are closed, the wrap-around shade or wrap around screen is connected to the crown and bill. If the separating zippers are open, the wrap-around sun shade or sun screen can be detached from the crown and/or the bill.

17 Claims, 2 Drawing Sheets

(56) References Cited

U.S. PATENT DOCUMENTS 5,121,507 A * 6/1992 Brown ..... A42B 1/004 2/10
5,293,646 A * 3/1994 Winston ..... A41D 13/05 2/115
5,448,778 A * 9/1995 Phillips ..... A42B 1/067 2/172
5,577,271 A * 11/1996 Davis ..... A01K 55/00 2/10
5,669,074 A * 9/1997 Newman, Jr. ..... A42B 1/067 2/172
5,669,075 A * 9/1997 Weeks ..... A42B 1/062 2/172
5,694,647 A * 12/1997 Crickmore ..... A42B 1/067 2/10
5,701,609 A * 12/1997 Bridges ..... A42B 3/16 2/172
D402,791 S * 12/1998 Mishal ..... D2/866
5,875,493 A * 3/1999 MacDonald ..... A01K 55/00 2/10
5,884,334 A * 3/1999 Collette ..... A42B 1/065 2/10
5,887,287 A * 3/1999 Potochnik ..... A42B 1/241 2/172
5,901,380 A * 5/1999 Mishal ..... A42B 1/067 2/10
5,924,129 A * 7/1999 Gill ..... A42B 1/062 2/10
5,950,241 A * 9/1999 Gomez ..... A42B 1/067 2/172
5,996,124 A * 12/1999 Asp, Jr. ..... A42B 1/241 2/172
6,070,270 A * 6/2000 De La Torre ..... A42B 1/206 2/10
6,167,569 B1 * 1/2001 Conner, IV ..... A42B 1/006 2/195.1
D459,573 S * 7/2002 Schechter ..... D2/866
6,996,852 B1 * 2/2006 Cabrera ..... A42B 1/062 2/171
7,103,920 B1 * 9/2006 Otterson ..... A42B 1/247 2/195.1
7,310,829 B1 * 12/2007 Engel-Wilson ..... A42B 1/067 2/175.6
7,343,630 B2 * 3/2008 Lee ..... A42B 1/067 2/175.6
7,971,278 B2 * 7/2011 Klamerus, Jr. ..... A42B 1/18 2/172
8,051,497 B1 * 11/2011 Erhardt ..... A42B 1/067 2/172
8,074,300 B1 * 12/2011 Molina ..... A42B 1/048 2/202
2007/0050889 A1 * 3/2007 Lee ..... A42B 1/067 2/171
2008/0066216 A1 * 3/2008 Yun ..... A42B 1/067 2/410
2009/0151049 A1 * 6/2009 Conrardy ..... A42B 5/00 2/206
2010/0186147 A1 * 7/2010 Garza ..... A42B 1/205 2/209.12
2013/0312156 A1 * 11/2013 Dean ..... A42B 1/067 2/172

* cited by examiner

HAT WITH WRAP-AROUND SUN SHADE

BACKGROUND OF THE INVENTION

The present invention relates to an article of clothing for protecting the upper body (including head, neck, and face) from radiation generated by the sun or other sources, and more specifically, to hats with sun shades.

The sun as an effective source of vitamin D is well established in the literature. However, it has also been established that too much sun can be detrimental to the health of human. Skin cancer is one of the adverse effects or disease cause by exposure to too much sun or other types of radiation. There are many types of skin cancers; but, it is believed, melanoma is the deadliest or most lethal. It is also believed to be the fastest growing type of cancer in the world. It is also believed that people with certain predisposed conditions make them more susceptible and put them at greater risk to develop skin cancer than others. For those people, even minimal exposure to the sun may result in developing skin cancer. Some predisposed conditions include genetics, fair skin, red or blonde hair, and light colored eyes. Another group of people that is susceptible are those recovering or recovered from the disease. Those people need to take special precaution to prevent recurrence. In order to minimize the risk of contacting a sun born disease, such as skin cancer, all people should limit exposure of their skin to sunlight.

There are several ways to protect one's skin from the sun. Probably, the simplest and straightforward way would be not to go into direct sunlight. This way appears impractical and unnecessarily limits one's activities to those that can be performed in shade or times when the sun is not shinning. This way would be most difficult for children who like to play and ride bicycles in daylight, when the sun is shinning. This way may also be difficult for and unacceptable to fishermen and fisherwomen who, by the nature of the sport, have to practice fishing in daylight, when the sun is shinning.

Another way to protect the skin from direct sunlight would be spending limited time in the sun. Even though limited time in the sun may be effective in protecting one's skin from direct sun light, it may not be suitable for people with predisposed conditions that make them vulnerable to develop skin cancer even with limited exposure to sun light. Still another way to protect the skin from direct sun light is to cover it with clothing. Stated another way, clothing may be used to protect the skin from deleterious effect of sun light. The clothing should be practical and does not restrict activities of the wearer. Clothing that meets these criteria and provides complete protection of the upper body could not be found and is deemed unavailable. The disclosed embodiment of the present invention, set forth below, meets these criteria and provides clothing that protects the entire upper body. As used in this document, clothing should be given broad interpretation including cap, hat or any type of garment used to cover the body of wearers.

SUMMARY

The present invention provides an article or piece of clothing that does not restrict activities of wearers and protects the upper body from direct sun light. As a consequence, a wearer may pursue activities in sun light or other source of ultra violet rays with minimum risk, if any, of contacting skin cancer. The article or piece of clothing has not been available here-before (before this invention). According to one embodiment of the present invention, the article or piece of clothing includes a hat having a crown and a bill extending outwardly from the crown. A wrap-around shoulder-length sun shade or sun screen or drapery is releasably coupled, by separating zippers, to the crown and bill of the hat. If the separating zippers are closed, the wrap-around shade or wrap-around screen is connected to the crown and bill. The wrap-around sun shade or sun screen can be detached from the crown and/or the bill by opening the associated separating zipper. The wrap-around sun shade or sun screen and associated separating zipper may be continuous or bifurcated.

In particular, bifurcated separating zippers are operably connected to the crown and bill, respectively. A first one of the bifurcated separating zippers includes two parts. A first part of the two parts is connected to the crown and a second part of the two parts is connected to a piece of fabric (termed sun shade or sun screen or drapery). The terms sun shade, sun screen, and drapery are used interchangeably in this document. The first part and second part of the first one of the bifurcated separating zippers can be integrally connected or separate (not connected). The integrally connected condition is referred as closed, whereas the separate (not connected) condition is termed open. If the respective parts of the first one of the bifurcated separating zippers are closed the sun shade or sun screen is connected to the crown and extends downwardly, from the crown, for a desired length. If the respective parts of the first one of the bifurcated separating zippers are open, the drapery is separated from the crown.

Likewise, the second one of the bifurcated separating zippers includes a third part connected to the bill and a forth part connected to a second piece of material which forms a second part of the wrap-around sun screen or sun shade or drapery. If the third part and the forth part of the second one of the bifurcated separating zippers are closed, the second piece of material (also termed sun screen or sun shade or drapery) extends downwardly for a predefined length, from the bill. When respective parts of the first one and the second one of the bifurcated separating zippers are closed, the associated sun shades or sun screens form a wrap-around sun shade or wrap-around sun screen to protect the upper body of the wearer. Likewise, the wrap-around sun shade or sun screen can be detached from the crown and bill of the hat by opening the respective parts on each of the bifurcated separating zippers. By detaching the wrap-around sun shade, the remaining crown and connected bill can be worn as a regular/conventional hat or cap. In addition, either the first part or the second part of the wrap-around sun shade may be detached, resulting in a partial removal of the wrap-around sun shade from the hat. The hat and non-removed part of the wrap-around sun shade would shield the head and portion of the upper body which is covered by the non-removed part of the wrap-around sun shade.

In another embodiment of the present invention, the separating zipper and associated sun shade are continuous. In particular, the part of the separating zipper that is attached to the crown and bill of the hat is continuous. Likewise, the part of the separating zipper connected to the sun shade is also continuous. The close and open configurations of the separating zipper as set forth above are equally applicable to this embodiment. As a result, the continuous sun shade may be connected or disconnected from the hat.

This invention provides an article of clothing that can be configured to provide complete blocking and/or partial blocking of the sun from contacting the upper body of a wearer. This versatility is a benefit because a wearer can configure the single article of clothing to suit his or her needs. This freedom to configure a single article of clothing to meet a desired need could not be found in the prior art.

BRIEF DESCRIPTION OF THE SEVERAL VIEWS OF THE DRAWINGS

These and other features and advantages of the present invention will be better understood by reference to the following detailed description when considered in conjunction with the accompanying drawings wherein.

DETAILED DESCRIPTION

Figure 1:
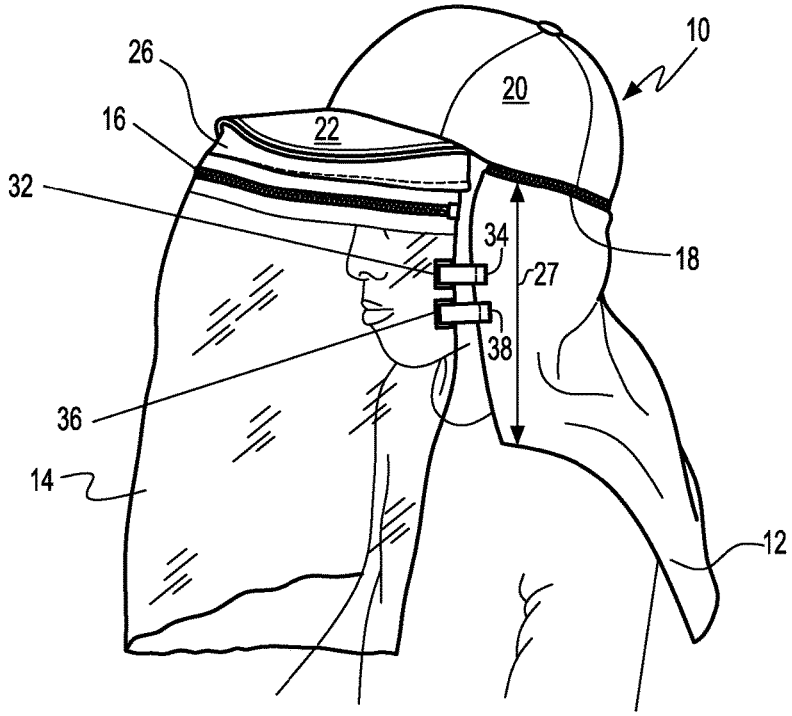
FIG. 1 or FIG. 1 is a schematic view of the clothing assembly draped or mounted on a person.

With reference now to FIG. 1, the clothing assembly, according to an embodiment of the present invention, mounted or draped on the upper body of a wearer is shown. As used in this document the upper body includes head, face, jaws, and neck of a person. These parts of the body are not fully protected, against radiation generated by the sun or other artificial sources, by currently available sun shades. As a result, the unprotected upper body is susceptible to disease, such as skin cancer, caused by exposure to sun light and other artificial sources. The upper body of a wearer is completely covered by the disclosed embodiment of the present invention As a consequence, the risk of getting skin cancer due to exposure to the sun is eliminated or significantly reduced. The clothing assembly, of the disclosed embodiment, also allows a wearer to pursue activities, such as bicycle riding, fishing etc., in sunlight without fear of contacting skin cancer or other associated diseases caused by the sun or other artificial sources.

Still referring to FIG. 1, the clothing assembly includes a hat 10, wrap around drapery 12 and 14, and mechanisms for attaching and detaching the wrap around drapery from the hat. For example, the mechanisms may include separating zippers 16 and 18 which releasably interconnect the wrap around drapery to the hat. In order to maintain consistency, common numerals are used to identify the same parts or elements in various views of the drawing. The hat 10 includes a crown 20 having a front side, a back side, and two lateral sides opposite to each other, and bill 22 connected to the front side of the crown. Only one of the lateral sides is shown in FIG. 1. The other lateral side (not shown) is substantially the same as the one that is shown. As a result, the description of the lateral side that is shown is intended to cover the lateral side that is not shown. A standard adjustment strap 24 (FIG. 2) as is known in the art is positioned at the backside of the crown 20. The adjustment strap allows a single size to fit different size heads. Alternatively, the crown 20 may be designed in different sizes to fit different sized heads. When worn by a person, as shown in FIG. 1, the crown covers the head of the wearer, the front side is substantially aligned with the face of the wearer, the back side is substantially aligned with the back of the head and neck of the wearer, the lateral sides are substantially aligned with the opposite jaws or sides of the face, and the bill extend over the face of the wearer.

Referring again to FIG. 1, the bill 22 has a concave surface next to or above the face of the wearer and a convex surface opposite to the concave surface. The bill may take other shapes, such as flat etc. The relationship of the bill 22, including length and width, to the crown 20 depends on the design, but can use the same design as is currently used for a conventional hat. The crown 20 may take any of the shapes and sizes available in a conventional hat and/or conventional cap. However, the size should be appropriate to fit comfortable on the head of a human. The crown may be fabricated from a single piece of fabric, such as organic cotton. The bill may be fabricated form a semi rigid material. Preferable, the crown 20 and bill 22 have the same color. Alternately, the crown may be fabricated from a plurality of panels. The panels may be fabricated from the same or different material.

The wrap around drapery is bifurcated into two sections, namely: partial wrap drapery 12 and partial wrap drapery 14. The separating zipper is also bifurcated, including zipper 16 and zipper 18. The partial wrap drapery 12 is connected to the backside and lateral sides (only one of which is shown) of hat 10 by separating zipper 18. The partial wrap drapery 14 is connected to bill 22 by separating zipper 16. Depending on the design of the hat there may be a nominal offset between respective ends of zipper 16 and zipper 18 on both sides of the hat. Notwithstanding, at these junctures the ends of partial drapery 12, supported by separating zipper 18, and the ends of partial drapery 14, supported by separating zipper 16, are substantially in contact to block sun light.

Figure 2:
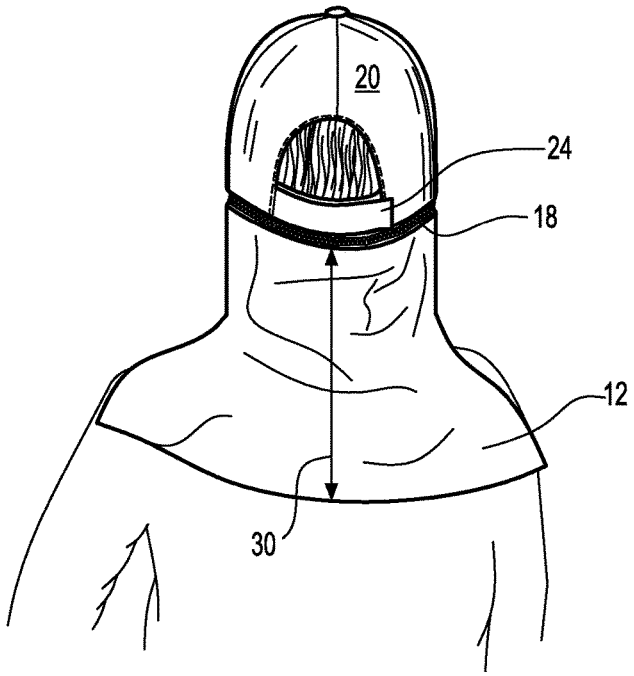
FIG. 2 or FIG. 2 is a schematic rear view of a part or section of the wrap around drapery connected to the crown by one of the separating zipper.

The construction of separating zipper 16 and separating zipper 18 is identical. Therefore, the description of one is intended to cover the other. The separating zipper 18 is a conventional zipper which can be purchased off the shelf. This type of zipper is available in different lengths. The construction and operation of this type of zipper is well known. Therefore, a detailed description is not warranted. Suffice it to say separating zipper 18 consists of two mating parts and a sliding button or lever to close or open (separate) the parts. With reference to FIG. 3*b*, one of the parts 18*a* is fixedly connected to crown 20. This may be done by stitching 18*a* to the bottom edge of crown 20. The mating part to 18*a* (not shown) is stitched (fixedly connected) onto an edge of partial wrap drapery 12 (FIG. 1 and FIG. 2). The part 18*a* (FIG. 3B) is fabricated with a receptacle or catch (not shown) at one of its ends in the vicinity of sliding button 28. A pin or spindle (not shown) is fabricated on one end of the other part (not shown, of separating zipper 18) connected to partial drapery 12 and mates with 18*a*.

In operation, the spindle (not shown) on the mating part (not shown) of separating zipper 18, connected to partial drapery 12, is inserted into the receptacle (not shown) on 18*a* (FIG. 3B). By moving the button 28 in a first direction, the zipper is closed, thereby, causing partial wrap drapery 12 to be connected to the crown as shown in FIG. 1 and FIG. 2. By moving button 28 in the opposite direction, the zipper is open, thereby separating partial wrap drapery 12 from crown 20. In FIG. 1, zipper 18 is shown in the closed position, thus causing partial wrap drapery 12 to be connected to crown 20. The partial wrap drapery 12 may be disconnected (not shown) by moving the button (not shown) in the opposite direction. The dimension (length) of 18*a* (FIG. 3*b*) varies depending on the design of hat 10 and/or crown 20. Regardless of these variations, the length of 18*a* should be sufficient to provide coverage for a hat designed to be worn by a person with normal sized head. It is believed that a length of approximately twelve to sixteen inches will suffice. Other dimension may be determined as appropriate, but still would be covered by teachings of the disclosed embodiment.

Figure 3A:
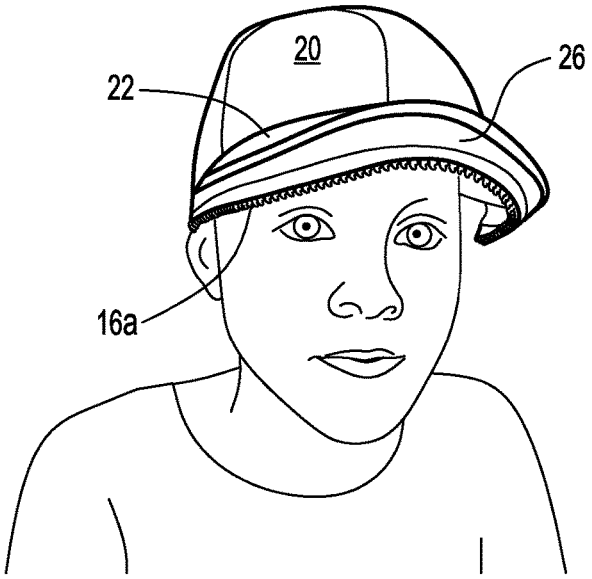
FIG. 3A or FIG. 3A and FIG. 3B or FIG. 3B depict different views of the hat and parts of the separating zipper mounted on the head of a person.
Figure 3B:
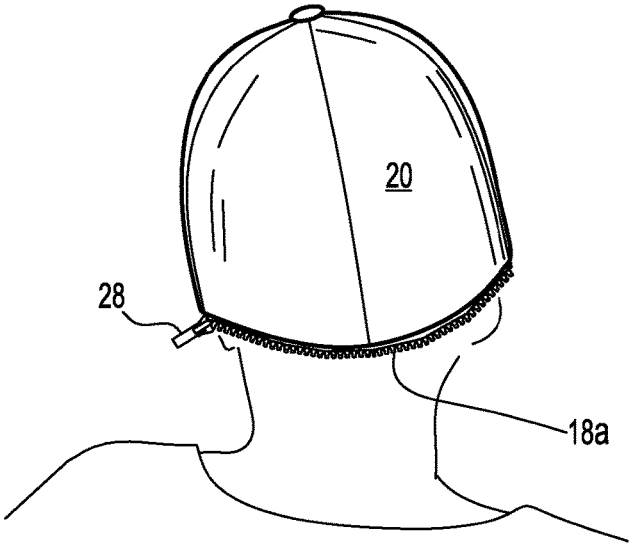

With reference to FIG. 1 and FIG. 3*a*, separating zipper 16, if in the closed position shown in FIG. 1, attaches partial wrap drapery 14 to bill 22. If in the open position (not shown) the partial wrap drapery 14 is detached from bill 22. The structure and operation of separating zipper 16 are identical to the description of separating zipper 18 set forth above and incorporated herein by reference. Therefore, further discussion of the structure and operation of separating zipper 16 are not warranted. Support member 26, for anchoring separating zipper 16, is fixedly attached (sown) to the concave surface of bill 22. Preferably, support member 26 is fabricated from the same material as the hat and extends downward approximately one to two inches from the concave surface of bill 22. Similar to the discussion of separating zipper 18, set forth above, separating zipper 16 has two mating parts. One of the two mating parts is labeled 16*a* fixedly attached to support member 26. The dimension (length) of support member 26 and separating zipper 18 should be sufficient to track the contour of the bill. This suggests that these dimensions could vary depending on the design of the bill. It is believed that a length approximately between ten and fourteen inches will be sufficient. Dimensions outside of this range may be required for some designs. Any such diversion would still be covered by the disclosed embodiment of the invention.

Referring again to FIG. 1 and FIG. 2, the bifurcated wrap around drapery includes partial wrap drapery 12 and partial wrap drapery 14. The partial wrap drapery 12 can be attached or detached from the crown 20 by separating zipper 18, details of which are set forth above and incorporated herein by reference. Other mechanism that allows partial wrap drapery 12 to attach or detach from the crown 20 can be used without departing from teachings of the disclosed embodiment. The geometry of partial wrap drapery 12 may vary depending on the design of the hat and/or size of the wearer. In one arrangement, the distance 28 extending laterally from the crown to the shoulder of a conventional hat worn by an average size wearer is approximately five to six inches. The matching measurement 30 when viewed from the back as shown in FIG. 2 is approximately twelve inches. Other geometries and measurement may be used without departing from teachings of the disclosed embodiment. As shown in FIG. 1, connectors 32, 34, 36, and 38 may be attached to partial wrap drapery 12 and partial wrap drapery 14. When engaged, the connectors can be used to connect partial wrap drapery 12 and partial wrap drapery 14. For example, the connectors may be Velcro strips, snap (male/female), buttons and corresponding holes or other types of connectors. These types of connectors are well known in the art and further discussion on them is not warranted.

The partial wrap drapery 12 is fabricated from a material or fabric, such as organic cotton, that blocks ultraviolet rays present in sunlight and light generated from other artificial sources. It is believed that these ultraviolet rays could cause skin cancer. The material should be opaque to block lights from the sun or other artificial source from contacting the skin. For example, an organic cotton material could be used. Alternatively, the ultraviolet rays blocking component could be embedded, coated, partially embedded, or partially coated onto a substrate the combination forming the material. The partially wrap drapery 12 should be sized with one dimension, termed length, sufficient to extend from one side of the crown 20, across the backside of the crown to the other side of the crown. Another dimension, termed width, could be shoulder length, extending from the lower edge (rim) of the crown 20 to the shoulder of the wearer. A set of typical measurements for the partial wrap drapery 12 is length approximately fourteen inches and width (measured from the rim at the backside of the crown down the back of the wearer) is approximately twelve inches. Other measurements can be used without departing from the teachings of the disclosed embodiment.

Referring again to FIG. 1, partial wrap drapery 14 is transparent and blocks ultraviolet rays. The partial wrap drapery 14 may be formed from clear plastic overlay with a relatively thin film that blocks ultraviolet rays. For example, the SOLAR-X sun control film manufactured and market by SOLAR-X Corporation of Newton, Mass., may be suitable. Alternately, the ultra violet blocking material could be embedded in the clear plastic. Other types of transparent material capable of blocking ultra violet rays may be used without deviating from the teachings of the present invention. Any such selection and use of material is intended to be covered by teachings and claims of the present invention. It can be attached or detached from the bill 22 by a mechanism such as separating zipper 16 previously discussed and incorporated herein by reference. Other types of mechanism for attaching and detaching partial wrap drapery 14 from the bill can be used without departing from the teachings of the disclosed embodiment. The material used can be clear plastic treated to block ultraviolet rays. One dimension of the clear plastic should straddle the width of the bill on its concave surface and another dimension should be shoulder length. Typical measurements may include twelve inches for the dimension that straddles the concave surface of the bill 22 and approximately six inches for the shoulder length that extends downwardly from the concave surface. These measurements are only exemplary and should not be construed as a limitation on the scope of the invention.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over protective clothing found in the marketplace, or to enable others of ordinary skill in the art to understand the embodiments disclosed herein.

What is claimed is:

1. A clothing assembly for blocking ultra violet rays comprising:

a hat including a crown and a bill;

a wrap around drapery extending around the periphery at the lower edge of said crown and said bill, extending downward from said crown and said bill and providing shielding to block ultra violet rays from sun; and a mechanism for coupling the wrap around drapery to said hat, wherein said mechanism being operable to be placed in a first state wherein said wrap around drapery is coupled to said hat and a second state in which said wrap around drapery is detached from said hat wherein said bill includes a concave surface and a convex surface opposite to said concave surface, further including a support member connected to the concave surface of said bill wherein said support member extends substantially across a width of said concave surface and connect the wrap around drapery to said bill, wherein the mechanism for coupling the wrap around drapery to the hat includes a first coupling mechanism attached at a lower end of the support member and a second coupling mechanism attached to the drapery.

2. The clothing assembly of claim 1 wherein the crown includes a front, back, opposite sides, and the bill connected to the front of said crown.

3. The clothing assembly of claim 1 wherein said support member and said wrap-around drapery are made from material including cotton.

4. The clothing assembly of claim 1 wherein the support member has a length of one and a half inches extending downwardly from the concave surface of said bill.

5. The clothing assembly of claim 1 wherein the wrap around drapery is bifurcated with a first section fabricated from opaque material and a second section fabricated from transparent material wherein the first section and the second section are each releasable coupled to the crown and bill of the hat.

6. The clothing assembly of claim 5 wherein the opaque material includes fabric and the transparent material includes clear plastic.

7. The clothing assembly of claim 6 wherein said fabric and said clear plastic block ultra violet rays.

8. The clothing assembly of claim 5 wherein said opaque material, of the first section of said wrap around drapery, has a first predefined dimension sufficient to extend from one of said opposite sides across the back to another of said opposite sides.

9. The clothing assembly of claim 5 wherein the transparent material, of the second section of said wrap around drapery, has a first predefined dimension sufficient to traverse a rim of the beak.

10. The clothing assembly of claim 7 wherein said opaque material and said transparent material are coated with a material that blocks the ultra violet rays.

11. The clothing assembly of claim 7 wherein material for blocking the ultra violet rays is fabricated in said opaque material and said transparent material.

12. The clothing assembly of claim 1 wherein the first and second coupling mechanisms for coupling the wrap around drapery to the hat includes a first separating zipper and a second separating zipper.

13. The clothing assembly of claim 1 further comprising the crown having a front, back, first side and a second side wherein the back is opposite and spaced from the front, the first side is opposite and spaced from the second side and the bill connected to said front; the wrap around drapery is bifurcated having a first section fabricated from opaque material with a first predefined dimension extending from the first side across the back to the second side and a second predefined dimension extending downward from said crown; a second section fabricated from transparent material, said second section having a second predefined dimension coupled to and extending downward from the bill; a first separating zipper having a first section rigidly connected to said first section of said bifurcated wrap around drapery; and a second separating zipper having a second section rigidly connected to said second section of said transparent material.

14. The clothing assembly of claim 12, wherein the first separating zipper includes one section rigidly connected to the crown and a mating section rigidly connected to the wrap around drapery.

15. The clothing assembly of claim 12, wherein the second separating zipper includes a first section rigidly connected to the support member and a second section rigidly connected to the wrap around drapery.

16. The clothing assembly of claim 1 further including the crown having a front, back, first side, second side, and the bill connected to said crown;

Said mechanism for coupling further comprising;

a first separating zipper having a first section fixedly connected to said crown and extends from a predefined location on the first side, across the back to a predefined location on the second side;

a second separating zipper having a second section fixedly connected to said support member wherein said first second of first separating zipper abuts the second section of said second separating zipper at predefined locations on the first side and second side respectively.

17. The clothing assembly of claim 1, wherein said support member is sown into said bill.

* * * * *